United States Patent [19]

Hammond

[11] Patent Number: 4,457,038

[45] Date of Patent: Jul. 3, 1984

[54] HANDLE FOR DISPOSABLE BRUSH OR MOP HEAD

[75] Inventor: Dennis A. Hammond, Ottawa, Canada

[73] Assignee: Dustbane Products Limited/Les Produits Dustbane Limitee, Ontario, Canada

[21] Appl. No.: 442,121

[22] Filed: Nov. 16, 1982

[51] Int. Cl.[3] ..... A46B 17/02

[52] U.S. Cl. ..... 15/145; 15/144 R; 16/114 R

[58] Field of Search ..... 15/145, 144 B, 144 R; 16/114 R, 114 A, 110 R

[56] References Cited

U.S. PATENT DOCUMENTS

| | | | |
|---|---|---|---|
| 845,666 | 2/1907 | Ruckstuhl | 15/145 |
| 2,226,814 | 12/1940 | Gregg | 15/145 |
| 4,283,809 | 8/1981 | Prost | 15/145 |

FOREIGN PATENT DOCUMENTS

| | | | |
|---|---|---|---|
| 66886 | 5/1957 | France | 15/145 |

*Primary Examiner*—Chris K. Moore

*Attorney, Agent, or Firm*—Berman, Aisenberg & Platt

[57] ABSTRACT

A permanent handle for a disposable brush or mop head. The handle comprises an elongated hollow body having a bottom and top end, the bottom end to releasably frictionally engage a disposable brush or mop head and secure it in working position on the handle body. When it is desired to change the head, a plunger longitudinally movable within the elongated body is manipulated by the user to bear against a portion of the brush or mop head and dislodge it from frictional engagement with the body. In this manner the operator can avoid touching a soiled brush or mop head when removing it from the handle for replacement.

9 Claims, 3 Drawing Figures

HANDLE FOR DISPOSABLE BRUSH OR MOP HEAD

BACKGROUND OF THE INVENTION

The present invention relates to a handle for disposable brush or mop heads, and more particularly to a handle from which a soiled brush or mop head may be removed without touching by the user.

In the industrial, commercial and institutional cleaning field, brushes such as toilet brushes normally comprise plastic or wooden handles to which a brush or mop head is rigidly, permanently secured. When the brush or mop head is sufficiently worn or used, the entire device, handle and all, is thrown away and a new unit obtained to replace it. Because of the large numbers of such brushes used in a commercial cleaning service and the frequency with which they must be replaced, the cost of replacing the entire device may be very high. There would be a potentially great cost saving if, when the brush or mop head became worn or sufficiently used, it could be simply removed from the handle and replaced with a fresh brush or mop head.

Cleaning devices having replaceable heads are known. For example Rogers Canadian Pat. No. 524,038 dated Apr. 17, 1956, describes a replaceable toilet bowl cleaning swab device in which a handle is provided with a socket at one end for engaging a stud-like projection from a cleaning pad portion. To remove the pad when soiled, the user either grips the pad with the hand, or else wedges the pad for instance at the edge of a toilet bowl and pull to withdraw the handle. Palma et al Canadian Pat. No. 512,316 issued Apr. 26, 1955 describes a similar type of sponge cleaner device in which a disposable sponge head has a tongue to fit in a recess provided at one end of a permanent handle. U.S. Pat. No. 3,423,781 of Henson issued Jan. 28, 1969 describes and illustrates a detachable mop or broom head device, in which the head is secured to a dowel which fits into a cylindrical, spring-loaded sleeve secured to the bottom end of a permanent handle. Both the Palma et al and Henson devices require the user to grip the sponge or mop head to remove it from the handle.

Another type of toilet bowl cleaning device having a head which is detachable from the handle portion is described in Beck et al Canadian Pat. No. 551,353 issued Jan. 7, 1958. This reference describes a toilet bowl cleaner swab having a string built into the swab so that, when it is desired to detach the swab from the handle portion, the string is pulled to rupture the swab and detach it.

Prost U.S. Pat. No. 4,283,809 issued Aug. 18, 1981 describes a tube-like holding tool for a swab for cleaning, for example, interior components of machinery and the like. The swab, secured to a rod and having an absorbant tip, is held in a tube sufficiently small to prevent the swab tip from being inserted into the tube. Insertion of another rod, down the back end of the tube, to contact the end of the rod of the swab and eject it out the front end, is one manner described to remove the swab and rod from the tube. A similar type of swab holding tube, this time for swabs for collection of medical specimens, is described and illustrated in U.S. Pat. No. 3,712,296 of Gradone issued Jan. 23, 1973.

Other references of general background interest are Canadian Pat. No. 111,636 of Rife issued Apr. 28, 1908 and Canadian Pat. No. 523,765 of Greacen et al. issued Apr. 10, 1956 (both describing and illustrating clamptype handles for releasably holding sponges); U.S. Pat. No. 2,991,494 of Smith issued Jul. 11, 1961; U.S. Pat. No. 2,866,215 of Scully issued Dec. 30, 1958 and Canadian Pat. No. 996,321 of Jaklmczyk issued Sept. 7, 1976.

It is an object of the present invention to provide an economical permanent type handle for a disposable brush or mop head, from which a soiled head may be removed without requiring the user to touch the head. It is a further object of the present invention to provide such a handle which will be rugged and easy to use.

SUMMARY OF THE INVENTION

According to the present invention there is provided a handle for a disposable brush or mop head. The handle comprises an elongated hollow body having bottom and top ends. The bottom end releasably frictionally engages a disposable brush or mop head and secures it in working position on the handle body. The handle further comprises an elongated plunger means longitudinally movable between operative position, wherein the plunger bears against a portion of the brush or mop head to dislodge it from engagement with the elongated hollow body, and inoperative position in which the plunger does not bear against a portion of the brush or mop head when the latter is secured in working position on the handle body. A plunger actuation means is also provided, secured to the plunger and operatively exposed for manipulation by the operator, to cause movement of the plunger between operative and inoperative position.

The handle according to the present invention is simple and durable, yet economical to manufacture. For example, the elongated body and plunger may be made of extruded cylindrical tubing. The head of the brush or mop may have a cylindrical sleeve to be frictionally engaged by the bottom end of the elongated body in such embodiment.

BRIEF DESCRIPTION OF THE DRAWINGS

These and other objects and advantages of the invention will become apparent upon reading the following detailed description and upon referring to the drawings in which.

Figure 1:
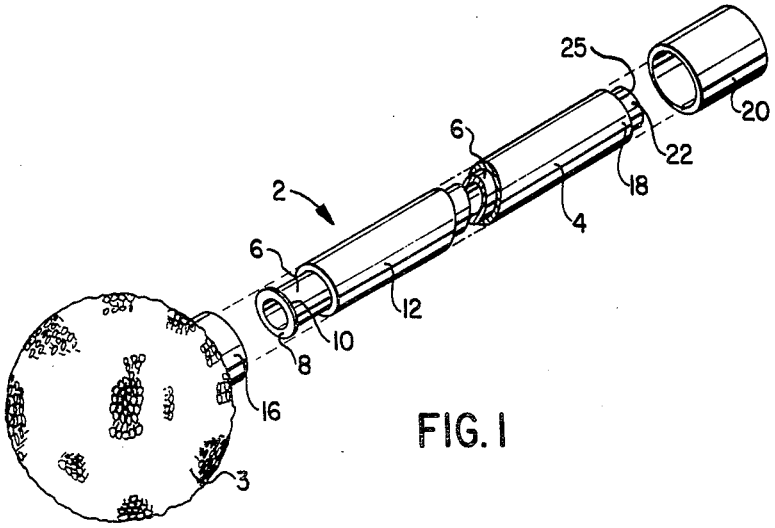
FIG. 1 is an exploded perspective view of a handle and disposable toilet brush according to the present invention, the plunger being in operative position for ejection of the brush from its position on one end of the handle.

While the invention will be described in connection with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 2:
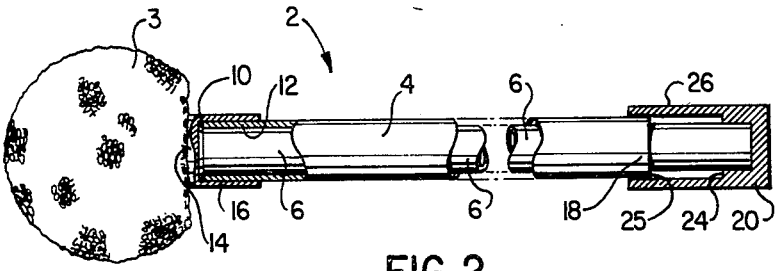
FIG. 2 is a side view in partial section of the brush and handle of FIG. 1 in assembled position, the plunger being in inoperative position.

Turning to FIGS. 1 and 2, there is illustrated a handle 2 shown associated with a disposable toilet brush 3. The handle comprises an elongated cylindrical body 4 within which plunger 6, having a body which is a cylindrical tube, is situated for longitudinal movement. The outer diameter of the body of plunger 6 is slightly less than the inner diameter of cylindrical body 4, such that plunger 6 is flushly held within cylindrical body 4 but relative longitudinal movement of the former within the latter is permitted. At the bottom end of plunger 6, is located a bearing surface 8. This bearing surface is oriented in a direction normal to the direction of longitudinal movement of the plunger. The bottom end portion of plunger 6 also ends in outward flare 10 as shown, so that the bottom end of plunger 6 cannot be withdrawn through cylindrical body 4 towards the top end. Brush 3 is releasably, frictionally secured to the bottom end 2 of elongated body 4 as illustrated in FIG. 2. Brush 3 is provided with a rigid body portion 14 having a sleeve 16 which receives in watertight, frictional engagement bottom end 2 of body 4. At top end 18 of body 4, secured to the top end 22 of plunger 6 by way of frictional engagement, is cap 20. Top end 22 of plunger 6 extends beyond the top end 18 of cylindrical body 4. Annular ledge 24 of cap 20 acts as a stop by bearing against top edge 25 of elongated body 4, to prevent movement of plunger 6 towards the bottom end of cylindrical body 4 beyond a certain point. Cap 20 is also provided with an overhanging skirt portion 26 (FIG. 2) which covers top end 18 and edge 25 of body 4 as the plunger moves within these limits of movement determined by cap ledge 24 and flare 10.

In operation, when plunger 6 is in inoperative position as illustrated in FIG. 2, with its bearing surface 8 immediately adjacent bottom end 12 of body 4, sleeve 16 of brush 3 circumscribes a portion of the bottom end 12 of body 4 and is securely held thereon. Bearing surface 8 does not bear against brush head 3 in a manner which would force it off of elongated hollow handle body 4. When it is desired to change brush head 3, the user simply depresses cap 20 with respect to cylindrical body 4, causing plunger 6 to move in the direction towards bottom end 12 of body 4 until stop edge 24 of cap 20 abuts against the top edge 25 of body 4. As it approaches this position, the plunger bears against the rigid body portion 14 of brush head 3, inside of sleeve 16, to produce a longitudinal force away from body 4 which causes brush head 3 to be dislodged from its engagement with body 4. The plunger is then in the position as illustrated in FIG. 1. In this way the user can remove a soiled brush head 3 from handle 2 without having to actually touch the soiled brush head or without having to wedge the brush head against a fixed object.

Figure 3:
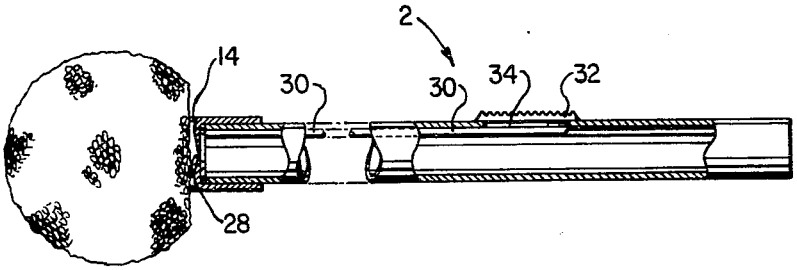
FIG. 3 is a side view in partial section of an alternative embodiment of handle according to the present invention.

In the alternative embodiment illustrated in FIG. 3, bearing surface 28 comprises simply a disk-like surface to bear against a rigid body portion 14 of brush head 3 when it is desired to remove it from handle 2. That bearing surface is secured by means of rod 30 to a slide 32 the movement of which slide (and hence of rod 30) is longitudinal its limits of movement being governed by the longitudinal limits of slot 34 in the body 4 of handle 2. The user simply manipulates slide 32 to move bearing surface 28 from inoperative to operative position to dislodge brush head 3 from handle 2.

Thus there has been provided in accordance with the present invention a handle for a disposable brush or mop head that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A handle for a disposable brush or mop head comprising:

(a) an elongated hollow handle body having bottom and top ends, the bottom end to releasably frictionally engage a disposable brush or mop head and secure it in working position on the handle body;

(b) an elongated plunger having bottom and top ends and being longitudinally movable between an operative position wherein the plunger is to bear against a portion of the brush or mop head when secured in working position to dislodge it from engagement with the elongated hollow body, and an inoperative position in which the plunger is not to bear against a portion of the brush or mop head when the latter is secured in working position on the handle body;

the hollow body and plunger being of cylindrical construction, the outer diameter of the plunger being slightly less than the inner diameter of the outer body to provide a flush but slidably movable fit of the plunger with respect to the cylindrical body, the bottom end of the plunger being slightly outwardly flared and, in said operative position, extending beyond the bottom end of the elongated body, the flare of the bottom end of the plunger preventing the bottom end of the plunger from being drawn past the body's bottom end; and (c) plunger actuation means secured to the plunger and operatively exposed for manipulation by the operator, to cause movement of the plunger between said operative and inoperative positions.

2. A handle according to claim 1 wherein the top end of the plunger remains extended beyond the top end of the hollow body when in said operative and inoperative positions, and wherein the plunger actuation means comprises a cap secured to the top end of the plunger, the cap having a bearing surface which comes into contact with the top end of the elongated body to act as a stop when the plunger is moved to operative position.

3. A handle according to claim 2 wherein the cap is provided with a circumscribing skirt beneath which the top end of the body remains situated when the plunger is in said operative and inoperative positions.

4. A handle according to claim 1 wherein, in operative position, the bottom end of the plunger projects beyond the bottom end of the elongated body to bear against a portion of the brush or mop head and dislodge it from frictional engagement with the body.

5. A handle according to claim 1 further comprising a head of a brush or a mop frictionally engaged by the bottom end of the handle body in a manner to permit its purposeful disengagement therefrom on movement of the plunger to said operative position.

6. A handle and head according to claim 5 wherein the hollow body is of cylindrical construction and the head is provided with a rigid sleeve to frictionally engage the bottom end of the body.

7. A handle according to claim 1 wherein the plunger comprises a bearing surface normal to the direction of longitudinal movement of the plunger to bear against a part of the body portion of the brush or mop head and force it in a longitudinal direction away from the elongated body, and an intermediate portion secured to and extending within the elongated body between the bearing surface and plunger actuation means.

8. A handle according to claim 7 wherein the intermediate portion comprises a rigid bar, and wherein the plunger actuation means comprises a slide means operatively associated with the elongated body to move longitudinally between said operative and inoperative positions.

9. A handle according to claim 8 wherein the longitudinal limits of movement of the plunger actuation means is governed by a longitudinal slot in the elongated body within which a portion of the slide means is positioned during operation.

* * * * *